United States Patent [19]

Wigdahl

[11] 4,341,258

[45] Jul. 27, 1982

[54] SOLDER RECLAIMING APPARATUS

[75] Inventor: Arthur G. Wigdahl, West Salem, Wis.

[73] Assignee: Richard C. Thompson, La Crosse, Wis.

[21] Appl. No.: 194,879

[22] Filed: Oct. 7, 1980

[51] Int. Cl.[3] ..... B22D 27/04; B22D 39/00

[52] U.S. Cl. ..... 164/337; 164/338.1; 164/341; 164/342

[58] Field of Search ..... 164/338 R, 338 M, 338 H, 164/342, 335, 47, 271, 410, 372, 341; 249/59

[56] References Cited

U.S. PATENT DOCUMENTS

| | | | |
|---|---|---|---|
| 231,877 | 8/1880 | Wiard | 164/372 |
| 358,585 | 3/1887 | Wellman | 164/338 M |
| 1,068,259 | 7/1913 | Mesick | 164/335 X |
| 1,378,984 | 5/1921 | Soss | 164/338 M |
| 3,579,799 | 5/1971 | Furstenburg et al. | 249/59 X |

FOREIGN PATENT DOCUMENTS

| | | | |
|---|---|---|---|
| 1347161 | 11/1963 | France | 164/335 |
| 720 | of 1854 | United Kingdom | 164/271 |

*Primary Examiner*—Gus T. Hampilos
*Attorney, Agent, or Firm*—B. P. Fishburne, Jr.

[57] ABSTRACT

A supported melting pot for recovered globules of solder includes a metering valve and feeder tube through which melted solder is delivered in controlled amounts to a die. The die includes separable sections, at least one of which is heated, and is provided with an elongated spiral molding groove. On each use of the apparatus, a spiral solder section having a length as great as twenty feet is produced.

1 Claim, 5 Drawing Figures

SOLDER RECLAIMING APPARATUS

BACKGROUND OF THE INVENTION

Solder contains 40% tin and is therefore quite costly. At the present time, new solder sells for $4.00–$5.00 a pound. A single worker in an automobile radiator reconditioning shop can use up to 100 pounds of solder a month. There are many other commercial uses of solder, such as the joining of electrical components in circuits. In view of the spiraling cost of solder, there is a great need for a simple, economical and practical reclaiming apparatus by means of which globules of used solder recovered in radiator shops and the like can be efficiently and conveniently returned to usable form by the tradesman with a considerable savings of money and without adversely effecting the products on which the reclaimed solder is used. The prime objective of this invention is to completely satisfy this need.

SUMMARY OF THE INVENTION

A recovered solder melting pot is suitably supported along with a separable die including opposing plate members, at least one of which includes a heating element. The lower die plate has a continuous long spiral groove which is completely filled with molten solder from the melting pot by periodic operation of a metering valve on the pot. The metered solder flows through a feed tube and spure opening which communicates with the casting or molding groove in the die. The die is maintained sufficiently hot to allow the molten solder to completely fill the spiral casting groove, following which the die plates are separated and a reclaimed spiral section of solder of about twenty feet in length is ready for removal and use by the tradesman.

DETAILED DESCRIPTION

Figure 1:
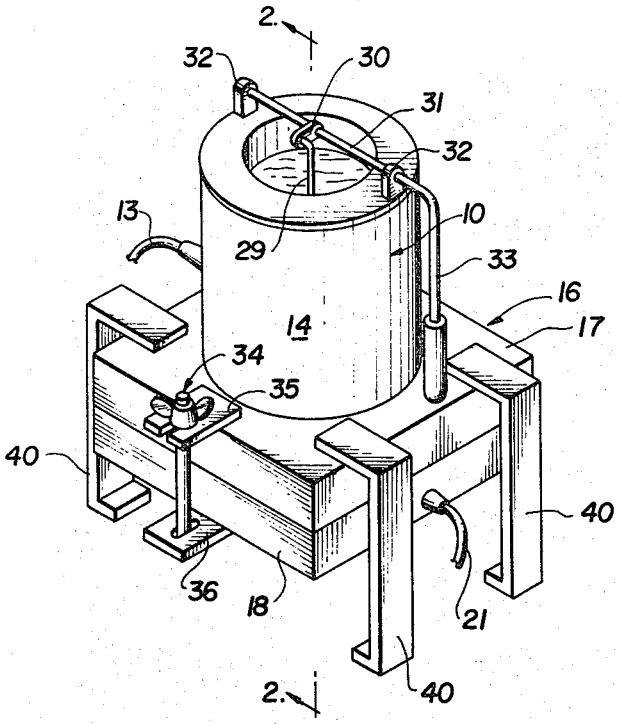
FIG. 1 is a perspective view of a solder reclaiming apparatus in accordance with the invention.

Referring to the drawings in detail wherein like numerals designate like parts, the numeral 10 designates a melting pot for used solder recivered from the tanks of radiator repair shops or other commercial operations where solder is employed in substantial amounts. The melting pot 10 includes an interior vessel 11 whose side wall contains an electrical heating element 12 powered through a cable 13. The melting pot further comprises an outer wall 14 space from the inner vessel, and the space between the two walls is filled with thermal insulation 15.

The melting pot 10 rests on and is suitably attached to a reclaimed solder casting die 16 consisting of an upper die plate 17 and a coacting low die plate 18. The two die plates are preferably rectangular and are hingedly connected along one edge by a hinge 19.

Figure 2:
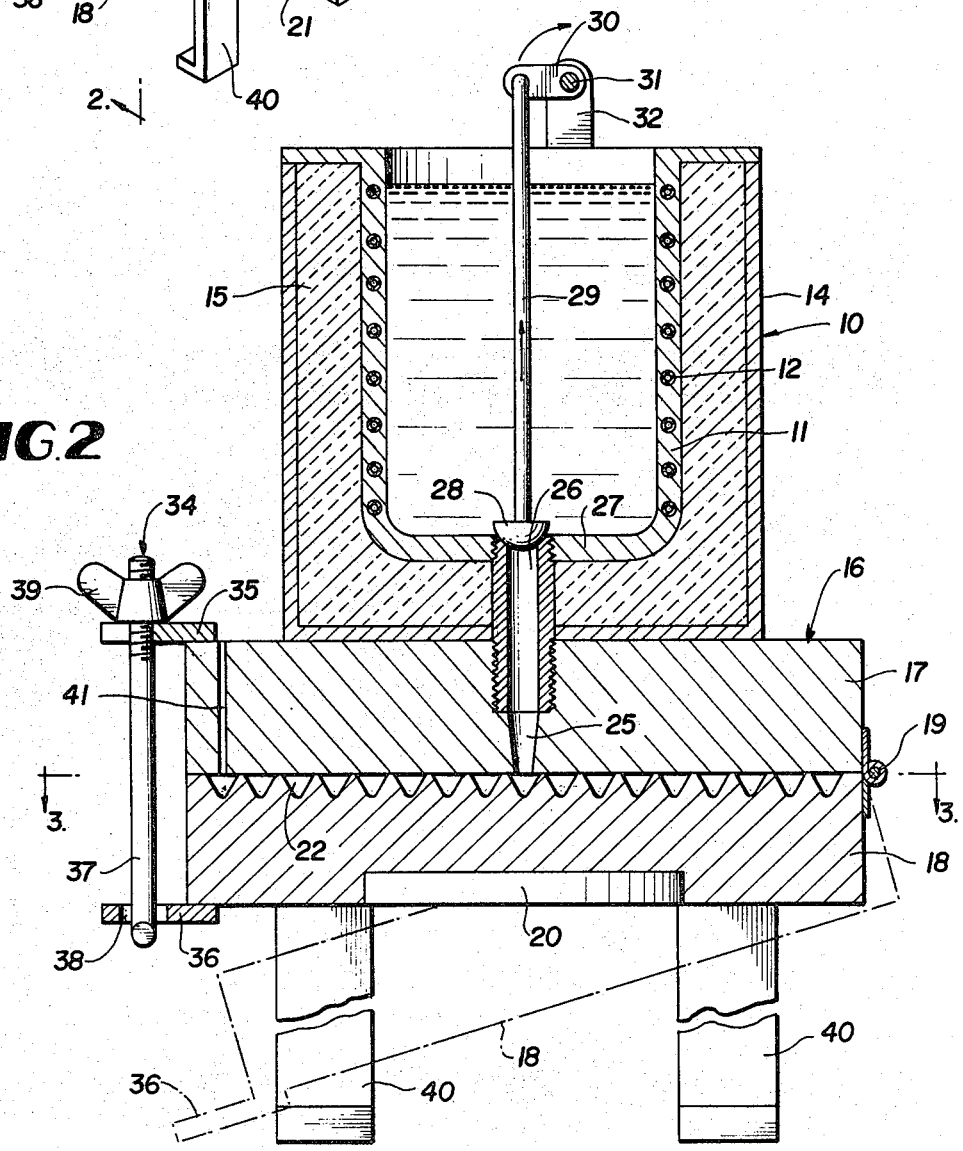
FIG. 2 is a central vertical section through the apparatus taken on line 2—2 of FIG. 1.
Figure 3:
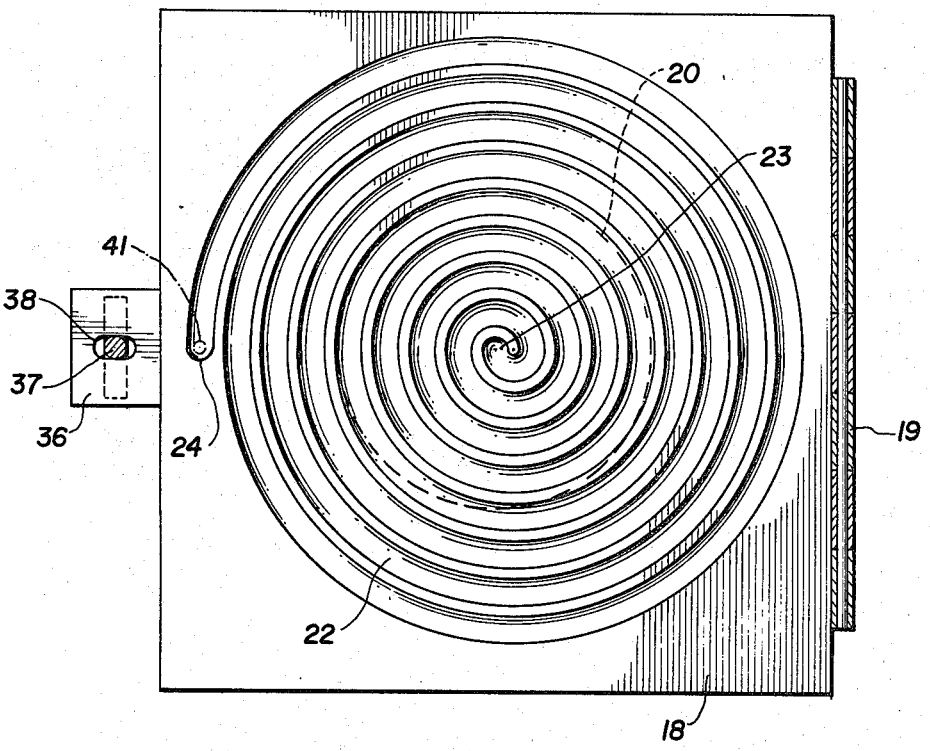
FIG. 3 is a horizontal section taken on line 3—3 of FIG. 2.

The lower die plate 18 is equipped with an electrical heating element 20 powered through a cable 21. The top face of the lower die plate 18 is provided with a long spiral groove 22 which is continuous and of uniform V-cross section, as best shown in FIG. 2. The inner terminal 23 of the spiral groove is located at the center of the plate 18 and it outer terminal 24 is located near one edge of the plate 18.

A sprue opening 25 in the flat upper die plate 17 feeds molten solder from the pot 10 to the inner terminal 23 of the spiral groove. The sprue opening communicates with a vertical feed tube 26 having one end anchored in the upper die plate 17 and its other end anchored in the bottom wall 27 of vessel 11.

A metering valve 28 adapted to seat upon the upper end of the feed tube 26 is carried by a valve stem 29 rising through the center of the vessel 11 and connected above the vessel with a short crank arm 30 attached to a horizontal rocker shaft 31 journaled in bearings 32 atop the melting pot 10. A preferably weighted hand lever 33 at one end of the rocker shaft 31 is swung manually to unseat the valve 28 and admit molten solder in controlled amounts to the feeder tube 26. Normally, the weighted hand lever 33 will maintain the valve 28 seated.

The two die plates 17 and 18 are maintained in closed abutting relationship by any suitable keeper means 34. This means may comprise a fixed slotted lug 35 on the upper die plate 17 and a similar slotted lug 36 on the lower die plate 28. A T-head bolt 37 engaging upwardly through the slot 38 of lug 36 carries a wing nut 39 at its top bearing on the lug 35. When this nut is loosened, the T-head bolt 37 may swing outwardly and downwardly to form a handle for lowering the die plate 18 on the axis of hinge 19 so that the cast reclaimed solder spiral may be conveniently removed from the groove 22. The apparatus is equipped with support legs 40 of appropriate length, as illustrated, and a small air vent 41 in the upper die plate 17 vents the outer terminal 24 of the spiral groove to atmosphere so that molten solder can run freely to the outer end of the groove.

Figure 5:
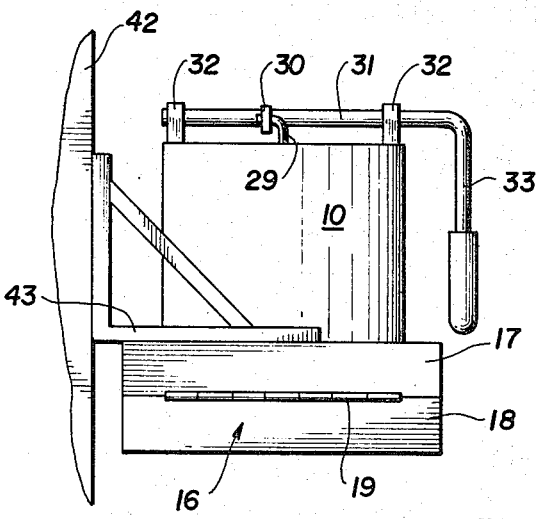
FIG. 5 is a side elevation of a solder reclaiming apparatus in accordance with a modification of the invention.

In lieu of the support legs 40, the apparatus can be mounted on a wall 42 as shown in FIG. 5 by a mounting bracket 43. In all other respects, the apparatus in FIG. 5 may be identical to that shown in the previously-described embodiment.

Figure 4:
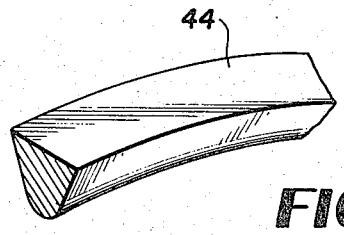
FIG. 4 is a fragmentary perspective view in cross section of a spiral solder element produced by the invention.

FIG. 4 depicts a small segment of the spiral reclaimed solder element 44 produced by the invention. As shown, the solder element conforms in cross sectional shape to the casting groove 22 and has a flat top face reflecting the flat bottom surface of the upper plate 17.

In use, globules of solder are placed in the pot 10 and melted by utilizing the heating element 12. The two plates 17 and 18 are locked in opposing relationship and the heating element 20 is activated. Molten solder is metered by operation of the valve 28 into the groove 22 to entirely fill the groove between the two terminals 23 and 24. The valve is then closed and the heating element 20 is de-energized and, after brief cooling, the keeper 34 is released and the lower die plate 18 is dropped downwardly to permit removal of the cast unitary reclaimed solder spiral of approximately twenty feet in length in a practical embodiment of the invention. The length of the spiral groove can be varied as can the overall size of the apparatus.

Other types of keepers for the die sections or plates may be employed in lieu of the arrangement shown at 34. The lower die plate 18 may have a handle to facilitate raising and lowering it. The melting pot 10 need not be fixed to the die structure and molten solder can be directed to the opening 25 in any practical manner. In some cases, the lower die plate 18 may have a cooling coil to speed up the operation and the heating element 20 could be equipped with a timer. It is necessary that the die structure be sufficiently heated when the molten solder is delivered to it to allow free flow of the solder to the outer terminal 24 of the spiral groove.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A self-contained scrap solder reclaiming apparatus comprising upper and lower superposed flat plate die sections having opposed mating surfaces which surfaces mate to define a horizontal mold parting plane a hinge having a horizontal axis of rotation and connected to each die section along opposed sides surfaces thereof, substantially rigid support legs for the apparatus, each leg having a first end attached to the upper flat plate die section and a second end spaced from said first end and adapted to contact a support surface upon which the apparatus rests, each of said second ends being spaced from said first ends by a distance measured along an axis normal to said horizontal mold parting plane, sufficient to extend substantially beyond the lower flat plate die section to enable the latter to swing downwardly from the upper flat plate die section to a reclaimed solder release position, a single readily releasable fastener element attached to the upper and lower flat plate die sections for securing the lower flat plate die section in opposing abutting relationship with the upper flat plate die section during a reclaiming process, an electrically heated melting pot for scrap solder fixed on the upper flat plate die section and having a bottom molten solder vertical axis feed tube anchored in a bottom wall thereof and projecting below the bottom wall to expose an external surface portion which surface portion is screw-threaded, the upper flat plate die section having surface portion defining a complimentary screw-threaded recess receiving the projecting screw-threaded portion of said feed tube and the upper flat plate die section defining a sprue opening in coaxial registration with a bore of the feed tube and extending through the mating surface of the upper flat plate die section, a metering valve including a generally vertical valve stem within the melting pot and adapted to be seated on and close an upper end of the bore of the feed tube, supporting and operating mechanism for the metering value on the melting pot connected to the stem of said valve near the top of the melting pot, the mating surface of the upper flat plate die section being a substantially smooth face, and the mating surface of the lower flat plate die section having formed therein a continuous long spiral casting groove of substantially V-cross section and having one terminal end substantially at the center of the mating surface of the lower flat plate die section in registration with the sprue opening and a second terminal end near a side surface of the lower flat plate die section whereby the spiral groove occupies a major portion of the surface area of the mating surface of the lower flat plate die section, the upper flat plate die section having a vent port formed therethrough in communication with the spiral casting groove near the second terminal end of the groove, and electrical heating means connected with the lower flat plate die section for heating at least said lower flat plate die section.

* * * * *